US008303795B2

(12) United States Patent
Virtanen et al.

(10) Patent No.: US 8,303,795 B2
(45) Date of Patent: Nov. 6, 2012

(54) METHOD FOR ARRANGING ELECTRODES IN AN ELECTROLYTIC PROCESS AND AN ELECTROLYTIC SYSTEM

(75) Inventors: Henri Virtanen, Pori (FI); Olli Jarvinen, Espoo (FI); Lauri Palmu, Helsinki (FI); Ilkka Laitinen, Pori (FI)

(73) Assignee: Outotec Oyj, Espoo (FI)

( * ) Notice: Subject to any disclaimer, the term of this patent is extended or adjusted under 35 U.S.C. 154(b) by 171 days.

(21) Appl. No.: 12/996,366

(22) PCT Filed: Jun. 5, 2009

(86) PCT No.: PCT/FI2009/050479

§ 371 (c)(1),
(2), (4) Date: Dec. 3, 2010

(87) PCT Pub. No.: WO2009/147301

PCT Pub. Date: Dec. 10, 2009

(65) Prior Publication Data

US 2011/0073468 A1 Mar. 31, 2011

(30) Foreign Application Priority Data

Jun. 5, 2008 (FI) ..... 20085550

(51) Int. Cl.
*C25C 3/16* (2006.01)
*C25C 3/08* (2006.01)

(52) U.S. Cl. ..... 205/374; 205/336; 204/242; 204/243.1; 204/244; 204/247.5; 204/267; 204/268; 204/286.1; 204/288; 204/297.01; 204/279

(58) Field of Classification Search ..... 204/242, 204/243.1, 244, 247.5, 267, 268, 297.01, 204/286.1, 288, 279; 205/336, 374
See application file for complete search history.

(56) References Cited

U.S. PATENT DOCUMENTS 687,800 A 12/1901 Walker (Continued)

FOREIGN PATENT DOCUMENTS

CL 43168 9/2000

(Continued)

OTHER PUBLICATIONS

G. A. Vidal et al., "Performance of Intercell Bars For Electrolytic Applications: A Critical Evaluation". Hydrometallurgy 2003—Fifth International Conference in Honor of Professor Ian Ritchie—vol. 5: Electrometallurgy and Environmental Hydrometallurgy, 2003, pp. 381-390.

(Continued)

*Primary Examiner* — Bruce Bell
(74) *Attorney, Agent, or Firm* — Buchanan Ingersoll & Rooney PC

(57) ABSTRACT

In the method and system, a number of electrolytic cells are arranged as a cell group, which cells are separated by a number of partition walls; in each cell, a number of anodes and cathodes are arranged in an alternating order, so that in each cell, next to each anode, there is arranged a cathode, and so that in each cell, each individual anode is fitted in the same anode line with the anode of the adjacent cell, and in each cell, each individual cathode is fitted in the same cathode line with the cathode of the adjacent cell, and each anode is galvanically connected to at least one cathode of the adjacent cell. The flowing direction of the current passing in the cell group is deviated in different directions in order to make the current flow mainly in the direction of the cell group.

17 Claims, 12 Drawing Sheets

U.S. PATENT DOCUMENTS

Figure 1:
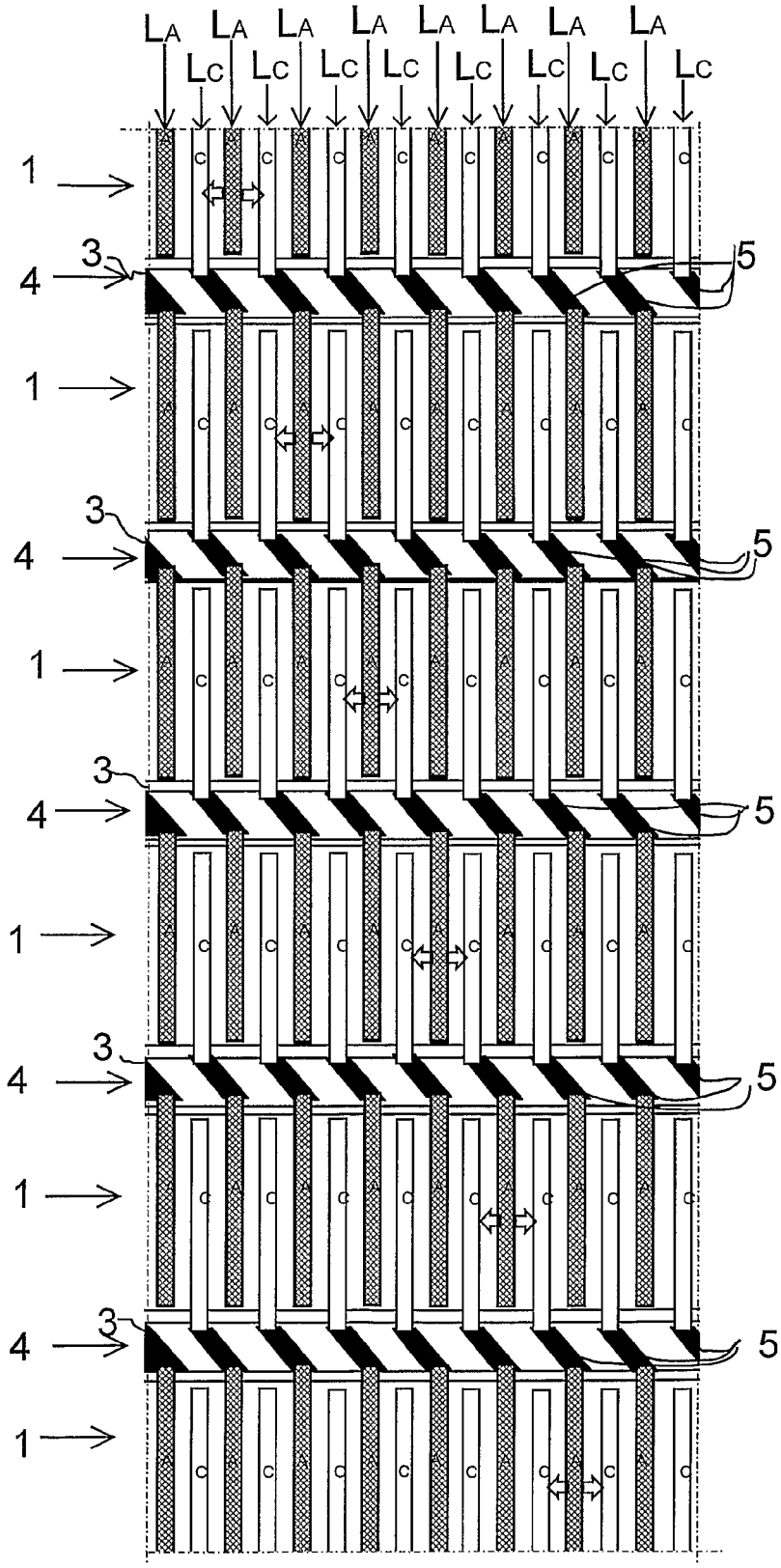
Prior Art Fig. 1

| | | | | |
|---|---|---|---|---|
| 1,206,965 | A | 12/1916 | Whitehead | |
| 4,224,127 | A * | 9/1980 | Schmidt-Hatting | 204/244 |
| 4,396,483 | A * | 8/1983 | Schmidt-Hatting | 204/244 |
| 4,474,611 | A * | 10/1984 | Blanc et al. | 204/279 |
| 4,950,370 | A * | 8/1990 | Tarancon | 205/619 |
| 4,976,841 | A * | 12/1990 | Boivin et al. | 204/244 |
| 5,830,335 | A * | 11/1998 | Antille | 204/244 |
| 6,342,136 | B1 * | 1/2002 | Virtanen et al. | 204/242 |
| 7,223,324 | B2 | 5/2007 | Dufresne | |
| 7,854,825 | B2 * | 12/2010 | Ebert | 204/297.01 |
| 8,123,917 | B2 * | 2/2012 | Dufresne | 204/297.01 |
| 8,142,627 | B2 * | 3/2012 | Vidaurre Heiremans | 204/297.01 |
| 2008/0078674 | A1 * | 4/2008 | Platonov et al. | 204/279 |

FOREIGN PATENT DOCUMENTS

| | | |
|---|---|---|
| EP | 1 095 175 A1 | 5/2001 |
| WO | WO 99/57337 A1 | 11/1999 |

OTHER PUBLICATIONS

Eduardo P. Wiechmannet al., "Current-Source Connection of Electrolytic Cell Electrodes: An Improvement For Electrowinning and Electrorefinery", IEEE Transactions on Industry Applications, vol. 42, No. 3, May/Jun. 2006, pp. 851-855.

International Search Report (PCT/ISA/210) issued on Oct. 2, 2009, by Finnish Patent Office as the International Searching Authority for International Application No. PCT/FI2009/050479.

International Preliminary Report on Patentability issued on Oct. 11, 2010, by Finnish Patent Office as the International Searching Authority for International Application No. PCT/FI2009/050479.

Finnish Search Report issued on Mar. 31, 2009 (with English language translation of category of cited documents).

G.A. Vidal et al., "Technological Improvement in Copper Electrometallurgy: Optibar Segmented Intercell Bars", Canadian Metallurgical Quarterly, vol. 44, No. 2, pp. 147-154, 2005.

Pablo E. Aqueveque et al., "Short-Circuit Detection For Electrolytic Processes Employing Optibar Intercell Bars", IEEE Industry Application Conference—Forty-Second IAS Annual Meeting, 2007, pp. 1746-1751.

Ilkka S. Laitinen et al., "Modelling and Simulation of a Copper Electrolysis Cell Group", Simulation Modelling Practice and Theory, vol. 16, Iss. 8, Sep. 2008, pp. 900-909.

* cited by examiner

METHOD FOR ARRANGING ELECTRODES IN AN ELECTROLYTIC PROCESS AND AN ELECTROLYTIC SYSTEM

FIELD OF THE INVENTION

The invention relates to a method for arranging electrodes in an electrolytic process. Further, the invention relates to an electrolytic system.

BACKGROUND OF THE INVENTION

The electrolytic reduction of metals (electrorefining or electrowinning) is carried out in several electrolytic cells, in which electrodes (anodes and cathodes) are loaded in an alternating order. Individual cells are arranged in cell groups by coupling the cells electrically in series by means of a separate contact system. This kind of contact system includes a busbar (so-called partition wall busbar), the task of which is to distribute the electric current evenly from the cathodes of the preceding cell to the anodes of the next adjacent cell.

From the field of electrolytic reduction of metals (electrorefining and electrowinning), there are known busbar systems representing two principal types.

The busbar system of the first main type is characterized by a uniform partition wall busbar. This kind of systems are widely used on the industrial scale in electrolytic plants. One application is known from a so-called Walker busbar system that is presented in the publication U.S. Pat. No. 687,800. There a number of electrolytic cells is arranged to form a cell group, where the cells are separated by a number of partition walls. In each cell, there are arranged in an alternating order a number of anodes and cathodes, so that in each cell, there is a cathode next to each anode. In addition, each individual anode in each cell is positioned in the same line—which in this specification is called the anode line—with the anode of the adjacent cell, and each individual cathode in each cell is positioned in the same line—which in this specification is called the cathode line—with the cathodes of the adjacent cell. A uniform busbar extending along the whole length of the cell is arranged on top of the partition wall between each of two adjacent cells in order to galvanically connect all of the anodes of the cell with all of the cathodes of the adjacent cell. In the publication EP 1095175 B1, the Walker system is developed further by adding equipotential bonding rails for the electrodes. The system is also known by the name "Outotec Double Contact Bus Bar System". It can be used for alleviating the effect of contact errors between the busbar and the electrodes.

The busbar system representing the other main type is characterized by a so-called segmented partition wall busbar, i.e. there the busbar is not uniform. This kind of segmented intercell busbar system (Optibar) is described in the following scientific articles:

1. /G. A. Vidal, E. P. Wiechmann and A. J. Pagliero, "Technological Improvements in Copper Electrometallurgy: Optibar Segmented Intercell Bars (Patent Pending)". Canadian Metallurgical Quarterly, Vol. 44, No 2. 2005, 147-154/,
2. /G. A. Vidal, E. P. Wiechmann and A. J. Pagliero, "Performance of Intercell Bars for Electrolytic applications: A Critical Evaluation". Hydrometallurgy 2003—Fifth International Conference in Honor of Professor Ian Ritchie—Volume 2: Electrometallurgy and Environmental Hydrometallurgy, 2003, 1381-1393./ and
3. /E. P. Wiechmann, G. A. Vidal and A. J. Pagliero, "Current-Source Connection of Electrolytic Cell Electrodes: An Improvement for Electrowinning and Electrorefinery", IEEE transactions is industry applications, vol. 42, no. 3, May/June 2006, 851-855/.

The present invention relates to segmented partition wall busbar systems according to the second main type mentioned above, and the Optibar system can be considered as representative of the nearest prior art with respect to the invention at hand.

FIG. 1 illustrates a known Optibar system. A number of electrolytic cells 1 is arranged to form a cell group, where the cells are mutually separated by a number of partition walls 3. In each cell, there are arranged, in an alternating order, a number of anodes A and cathodes C, so that in each cell, next to each anode A there is placed a cathode C, and further so that in each cell, each individual anode A is in the same anode line $L_A$ with the anode of the adjacent cell, and that in each cell, each individual cathode C is in the same cathode line $L_C$ with the cathode of the adjacent cell. The busbar 4 is arranged on top of the partition wall 3 arranged in between each adjacent cell. The busbar is formed of a row of conductor segments 5 that are separated galvanically from each other. Each conductor segment 5 is arranged to galvanically connect each anode A always with one cathode C of the adjacent cell. In each cell, the anode located in the anode line is galvanically connected by the conductor segment 5 in pairs (as can be seen in FIG. 1) to the cathode in the adjacent cell, located in the adjacent cathode line placed on the same side of the anode line. Thus the electric current proceeds directly from the cathode of the preceding cell to the anode of the following cell. Because each conductor segment in between different cells always proceeds in the same direction, inside the cell group electric current flows in parallel with the imaginary cell diameter (which is in the drawing illustrated by arrows drawn in between the anodes and cathodes; said arrows schematically illustrate the proceeding of current in the electrolyte in between the anode-cathode pairs).

Disturbances that are generally and typically detected in electrolysis are:

- contact error between electrode and busbar
- irregular electrode intervals (differences in distances between electrodes)
- short circuit between anode and cathode
- disturbances caused by the electrolyte (for example additive treatment of copper electrolysis).

The basis for a well functioning electrolysis is that current distribution for individual electrodes in the electrolytic cell is as even as possible, from the beginning of the electrolytic cycle to the end. Now, particularly in the beginning of the electrolytic cycle, the effect of contact errors between the electrodes and the busbar must be minimized. As a consequence of contact errors, for instance the specific energy consumption in the electrolysis and the probability of short circuits is increased. The created short circuits in turn result in a decrease of current efficiency. Also the irregularity in the mass distribution of the cell cathodes is likewise increased. Irregular electrode intervals (distance differences) are mainly due to electrode rifling errors, deviations in electrode thicknesses, bending of electrodes and wrong position in suspension. As a consequence of an irregular electrode interval, the distribution of electrolyte resistance in the cell group is not even. Further, as a consequence of an irregular electrode interval, the probability of short circuits is increased, and the current efficiency is decreased. In case of a short circuit, current proceeds through the short circuit directly from the anode to the cathode. Naturally this results in that the current efficiency is decreased, and the quality of the metal precipitated on the surface of a short circuited cathode is weakened.

A wrong composition of the electrolyte can mean that both the chemical and physical qualities of the metal precipitated on the cathode surface are weakened. The weakening of the physical quality results in an increase of the number of short circuits, and in a decrease of the current efficiency. By means of the structure of the partition wall busbar, it is possible to restrict the effects of the drawbacks caused by the three first types of disturbances.

The advantage of the segmentation of the partition wall busbar in the Optibar style is that it cuts down the short circuit current. Owing to the use of a segmented busbar, the current efficiency in the cell group is good also in case of a short circuit. A good current efficiency is achieved because the segmentation of the busbar restricts the quantity of the electric current that is transferred to the short circuited electrodes.

However, a drawback of the Optibar system is that it causes a remarkable distortion in the distribution of the effective current in the cell group, wherefore the Optibar system is problematic in use. This remarkable phenomenon has not been identified in the above mentioned articles /1/-/3/on the Optibar system, because there the cathode streams are observed by a coarse resistor network analysis. Instead, the articles emphasize the evenness of the current distribution.

Figure 2:
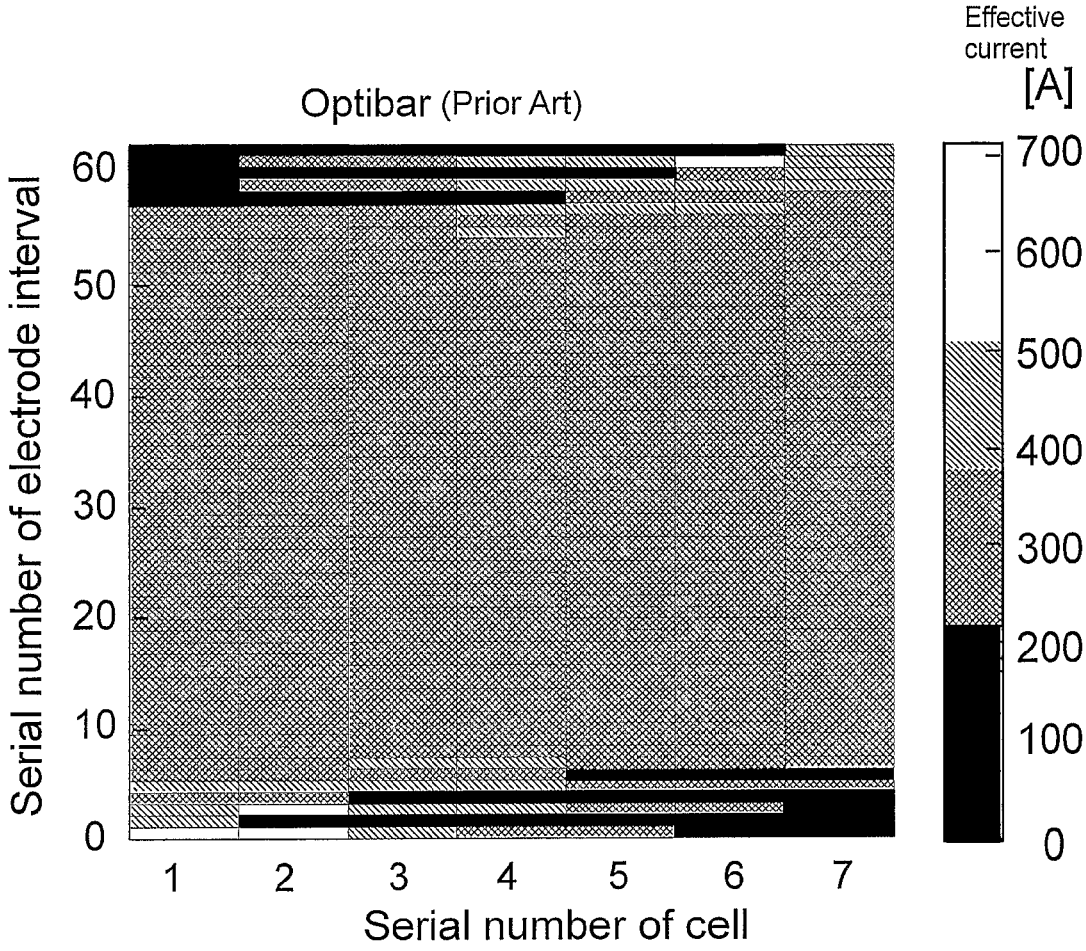

The distortion of the effective currents that takes place in the Optibar system is illustrated by FIG. 2 obtained from the FEM simulation model. FIG. 2 illustrates an electrolytic system that is meant for copper electrorefining. FIG. 2 is a schematical illustration of a cell group with 7 cells, where each cell includes 60 electrode intervals, i.e. 31 anodes and 30 cathodes. By FEM model simulation, there is obtained an effective current distribution in a cell group in a so-called ideal i.e. undisturbed situation according to the drawing, without short circuits etc. Here the term 'effective current' refers to the current passing through the electrolyte and participating in the metal precipitation process. As was mentioned above, it would be advantageous that the effective current distribution were as even as possible, so that the obtained layer of metal precipitated on the cathodes is evenly thick, i.e. the mass distribution of the cathodes is as even as possible. In the example, the optimal effective current in all electrode intervals of the whole cell group would be for instance 325 A. However, in the Optibar system of FIG. 2, the obtained current distribution range is large, extending from the value 0 A to the value of roughly 700 A, as can be seen from the vertical column on the right-hand side of the Figure. In the center of the cell group, the situation is still good, i.e. the effective current remains within an acceptable range, which in FIG. 2 is represented by the cross-hatched area. On the other hand, problems are detected at the ends of the cells, owing to an effective current that is either too high or too low. From the Figure it can be seen that in the last electrode intervals in the top left-hand corner, and in the first electrode intervals of the bottom right-hand corner, effective current does not flow at all, i.e. the prevailing effective current is 0 A. Now metal is not precipitated on the cathode at all. A deficient layer of precipitated metal on the cathode surface in turn causes problems in the mechanical separation of metal from the permanent cathode. Further, from FIG. 2 it is seen that the effective current in the electrode intervals in the bottom left-hand corner and in the top right-hand corner approaches the top limit 700 A of current distribution. An excessive effective current causes a rapid precipitation of metal on the cathode surface, which can result in short circuits.

OBJECT OF THE INVENTION

The object of the invention is to eliminate the above mentioned drawbacks.

A particular object of the invention is to introduce an electrolytic system, particularly suited in electrorefining, that has all the advantages offered by a prior art system provided with a segmented busbar, and at the same time avoids the drawbacks of said prior art system, i.e. provides an even current distribution and good current efficiency in a cell group.

Further, an object of the invention is to introduce an electrolytic system, where an even cathode mass distribution, a low probability of short circuits and a low specific energy consumption are achieved. The object is to obtain an improved quality of precipitated metal, an increased production output and a decreased energy consumption.

SUMMARY OF THE INVENTION

According to the invention, the flow direction of the current proceeding in the cell group is in the method deviated in different directions in order to make the current flow mainly in the direction of the cell group. Here the term 'the direction of the cell group' refers to the horizontal direction that is perpendicular to the lengthwise direction of the cell.

According to the invention, the conductor segments of the busbars are in the system arranged so that one or several anodes in one or several anode lines in one or several cells of a cell group are connected to one or several cathodes of the adjacent cell, of which cathodes at least one is located in the adjacent cathode line placed on the first side of said one or several anode lines, and that one or several anodes in some other one or several cells of the cell group, in said one or several anode lines, is connected to one or several cathodes of the adjacent cell, of which cathodes at least one is located in the adjacent cathode line placed on the other side of said one or several anode lines.

An advantage of the invention is that the deviation in the current distribution caused by the busbar segmentation is corrected in one or several cell intervals in the opposite direction, so that the current, flow proceeds essentially directly in the direction of the cell group, and not diagonally as in the prior art.

In comparison with the current distribution provided in the prior art system, the current distribution in the cell group of the invention becomes more even, because the so-called "inversion" of the partition wall busbars effectively corrects the deviation in the current distribution, caused by the geometry of the contact system. An even current distribution results in an even cathode mass distribution, a lower probability of short circuits and a lower specific energy consumption. Also the quality of the metal precipitated on the cathode surface is improved. Owing to the use of a segmented busbar, the current efficiency in the cell group is good, also in case of a short circuit. A good current efficiency is a consequence of the fact that the busbar segmentation restricts the magnitude of the electric current passed on to short circuited electrodes.

In an embodiment of the method, one or several anodes located in one or several anode lines in one or several cells of a cell group are connected to one or several cathodes of the adjacent cell, of which cathodes at least one is in the adjacent cathode line located on the first side of said one or several anode lines, and one or several anodes, located in some other one or several cells in said one or several anode lines of the cell group, are connected to one or several cathodes of the adjacent cell, of which cathodes at least one is located in the adjacent cathode line placed on the other side of said one or several anode lines.

In an embodiment of the method, one or several anodes, placed in one or several anode lines in an alternating order in every, second cell, are connected to one or several cathodes of the adjacent cell, of which cathodes, at least one is located in the adjacent cathode line placed on the first side of said one or several anode lines, and respectively one or several anodes, placed in said one or several anode lines in an alternating order in every second cell, are connected to one or several cathodes of the adjacent cell, of which cathodes at least one is located in the adjacent cathode line placed on the other side of said one or several anode lines. In this embodiment, the deviation in the current distribution is corrected in every second cell interval.

In an embodiment of the method, the individual anodes in each cell are galvanically connected to the individual cathodes of the adjacent cell.

In an embodiment of the method, two or several anodes of each cell are galvanically connected to each other and to a corresponding number of cathodes of the adjacent cell.

In an embodiment of the method, at the end of the cell, two or several anodes are connected to one or several cathodes of the adjacent cell.

In an embodiment of the method, the anodes in each cell are galvanically interconnected in order to balance the potential. Owing to the use of potential balancing, the cell group includes only few anodes that are in a serious contact error.

In an embodiment of the method, the cathodes in each cell are galvanically interconnected in order to balance the potential. Owing to the use of potential balancing, the cell group includes only few cathodes that are in a serious contact error.

In an embodiment of the system, one or several anodes, located in one or several anode lines placed in an alternating order in every second cell, are connected to one or several cathodes of the adjacent cell, of which cathodes at least one is placed in the adjacent cathode line located on the first side of said one or several anode lines, and respectively one or several anodes placed in an alternating order in every second cell in said one or several anode lines, are connected to one or several cathodes of the adjacent cell, of which cathodes at least one is located in the adjacent cathode line on the other side of said one or several anode lines.

In an embodiment of the system, each individual anode in each cell is galvanically connected to an individual cathode of the adjacent cell.

In an embodiment of the system, two or several anodes in each cell are galvanically connected to each other and to a corresponding number of the cathodes of the adjacent cell.

In an embodiment of the system, at the end of the cell, two or several anodes are connected to one or several cathodes of the adjacent cell.

In an embodiment of the system, the busbars include a first busbar and a second busbar, which is an inverted mirror image of the first busbar with respect to a vertical plane extending in the direction of the cell group.

In an embodiment of the system, the first and second busbars are arranged in an alternating order, on top of every second partition wall.

In an embodiment of the system, the anodes in each cell are galvanically connected to each other by a first equipotential bonding rail. The first equipotential bonding rail can extend along the whole length of the cell, to connect all anodes in the cell to each other. The first equipotential bonding rail can also extend to only part of the cell length, so that it connects several anodes, but not all of them. Such lengths of equipotential bonding rail can be located at the cell ends, and also in between the cell ends, somewhere in the middle region.

In an embodiment of the system, the cathodes in each cell are galvanically connected to each other by a second equipotential bonding rail. The second equipotential bonding rail can extend along the whole length of the cell, to connect all cathodes in the cell to each other. The second equipotential bonding rail can also extend to only a part of the cell length, so that it connects several cathodes, but not all of them. Such lengths of equipotential bonding rail can be placed at the cell ends, and also in between the cell ends, somewhere in the middle region.

The method and system are particularly feasible in the electrorefining process of metals.

LIST OF DRAWINGS

Figure 3:
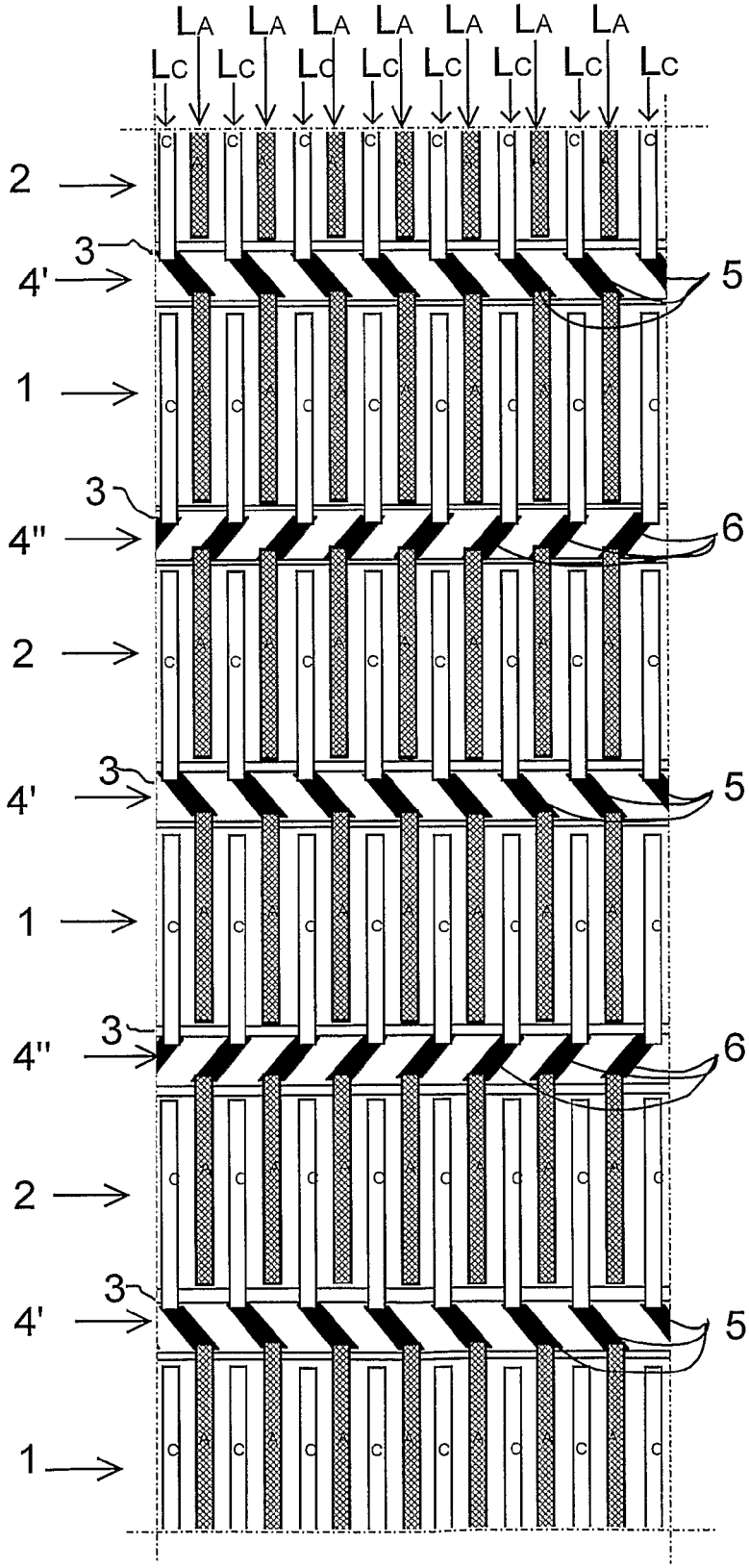
Figure 4:
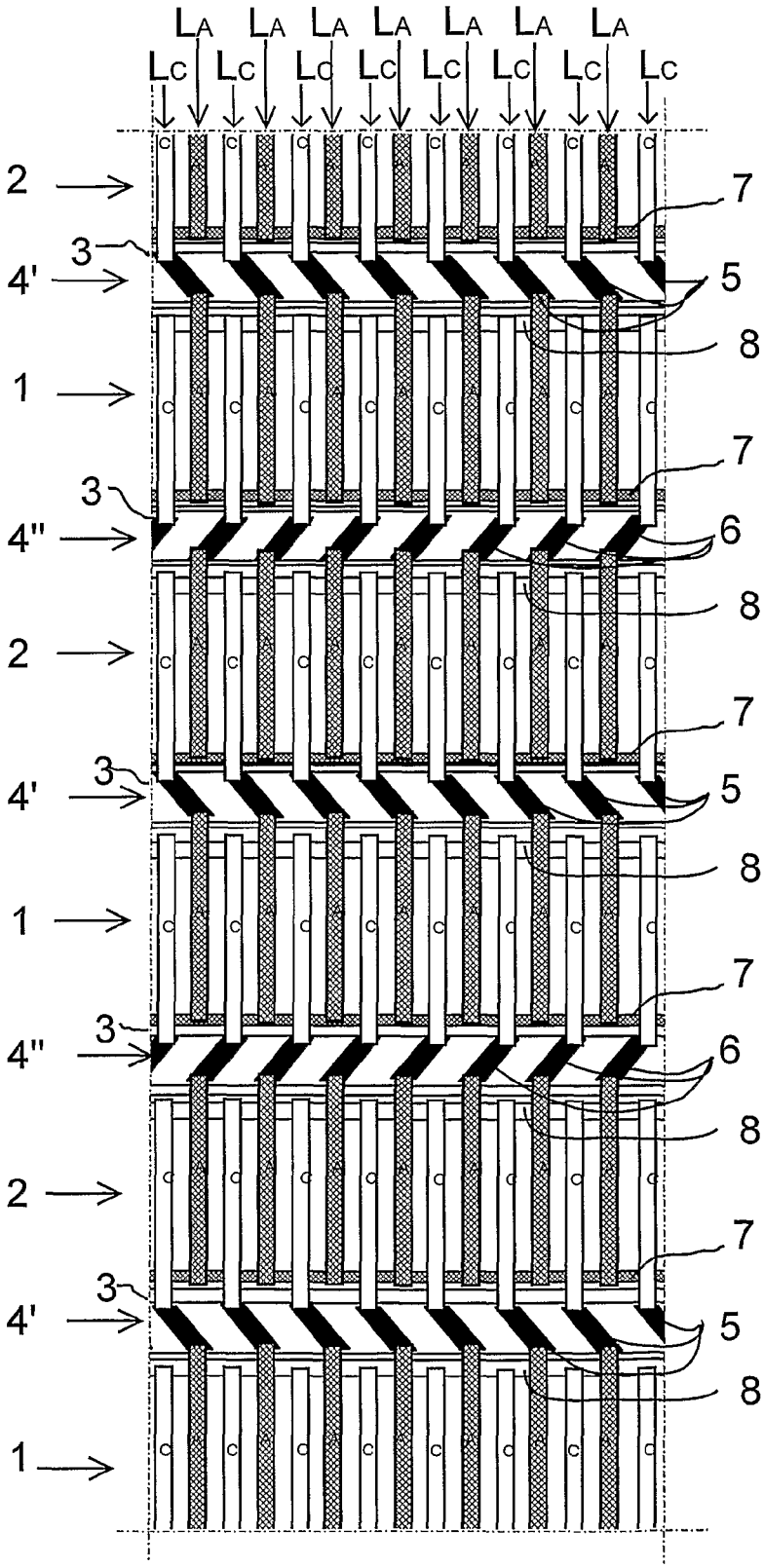
Figure 5:
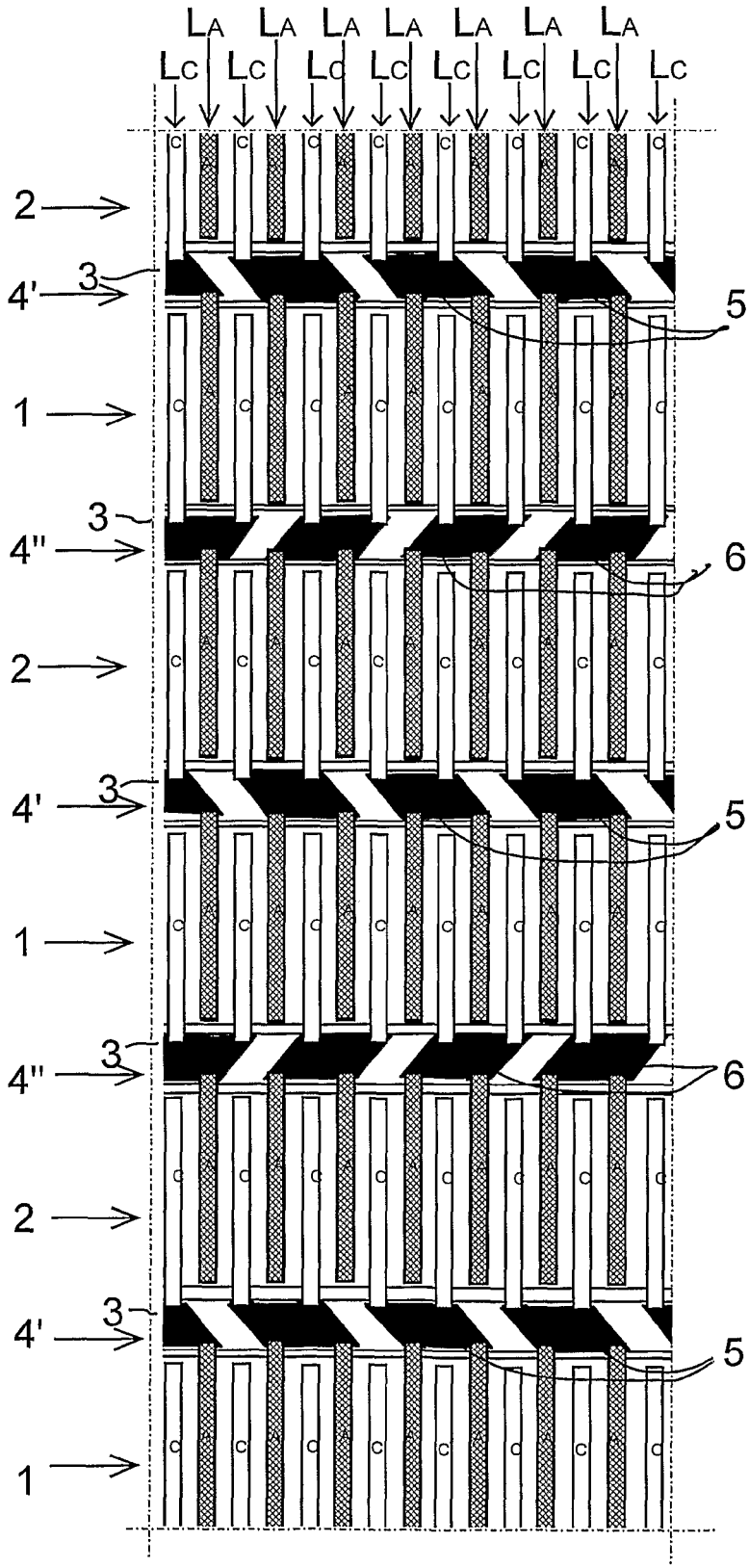
Figure 6:
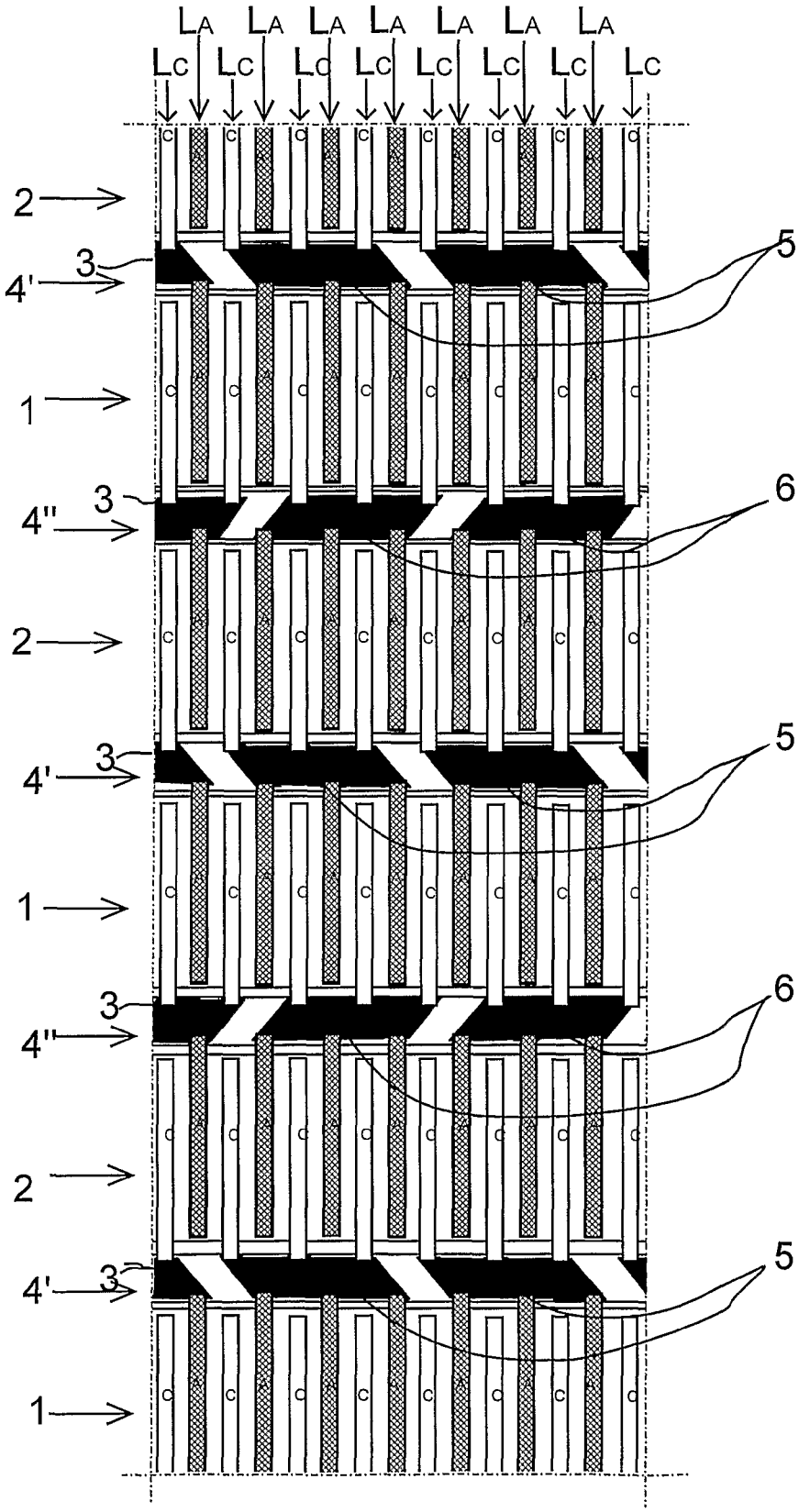
Figure 7:
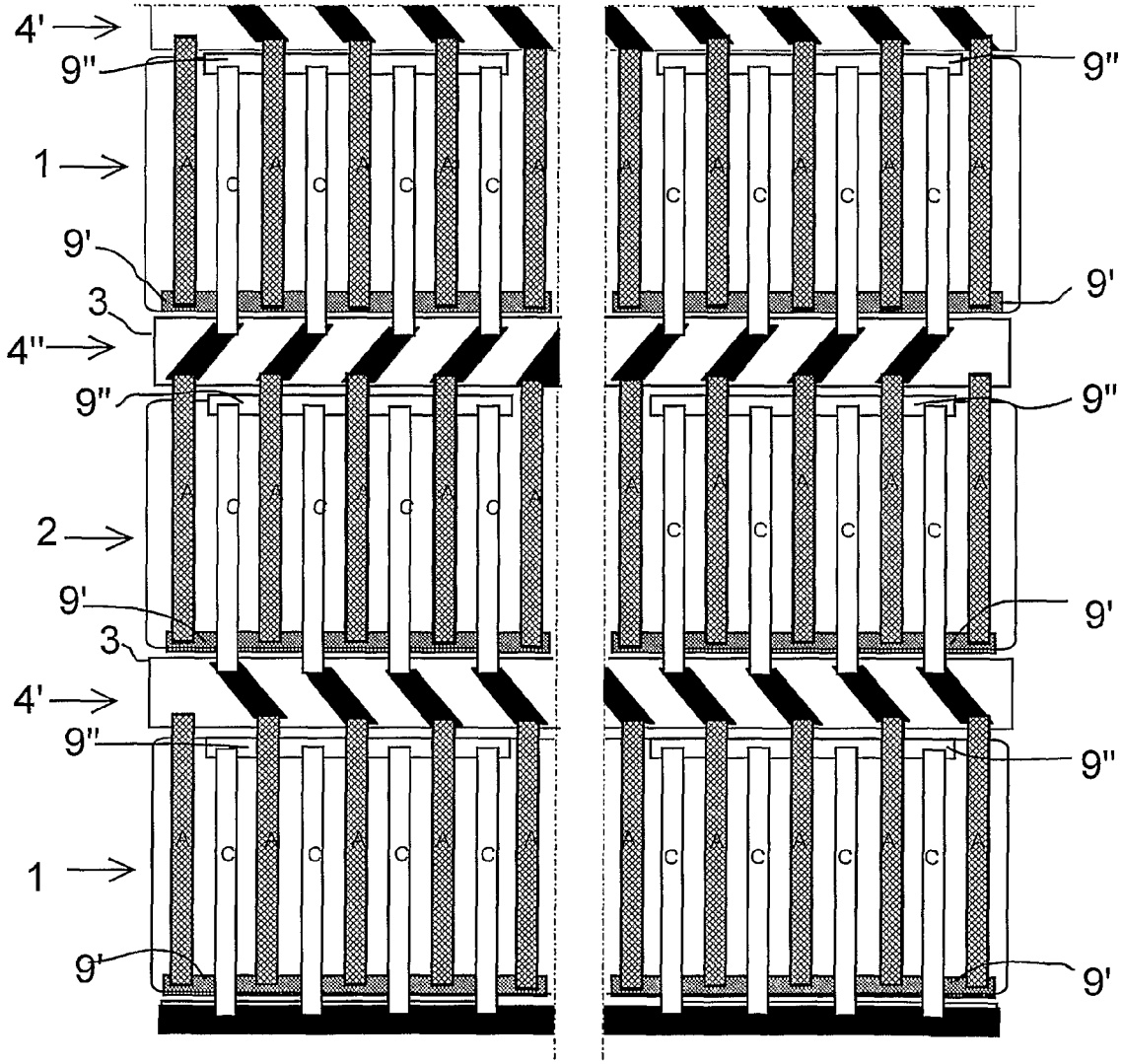
Figure 8:
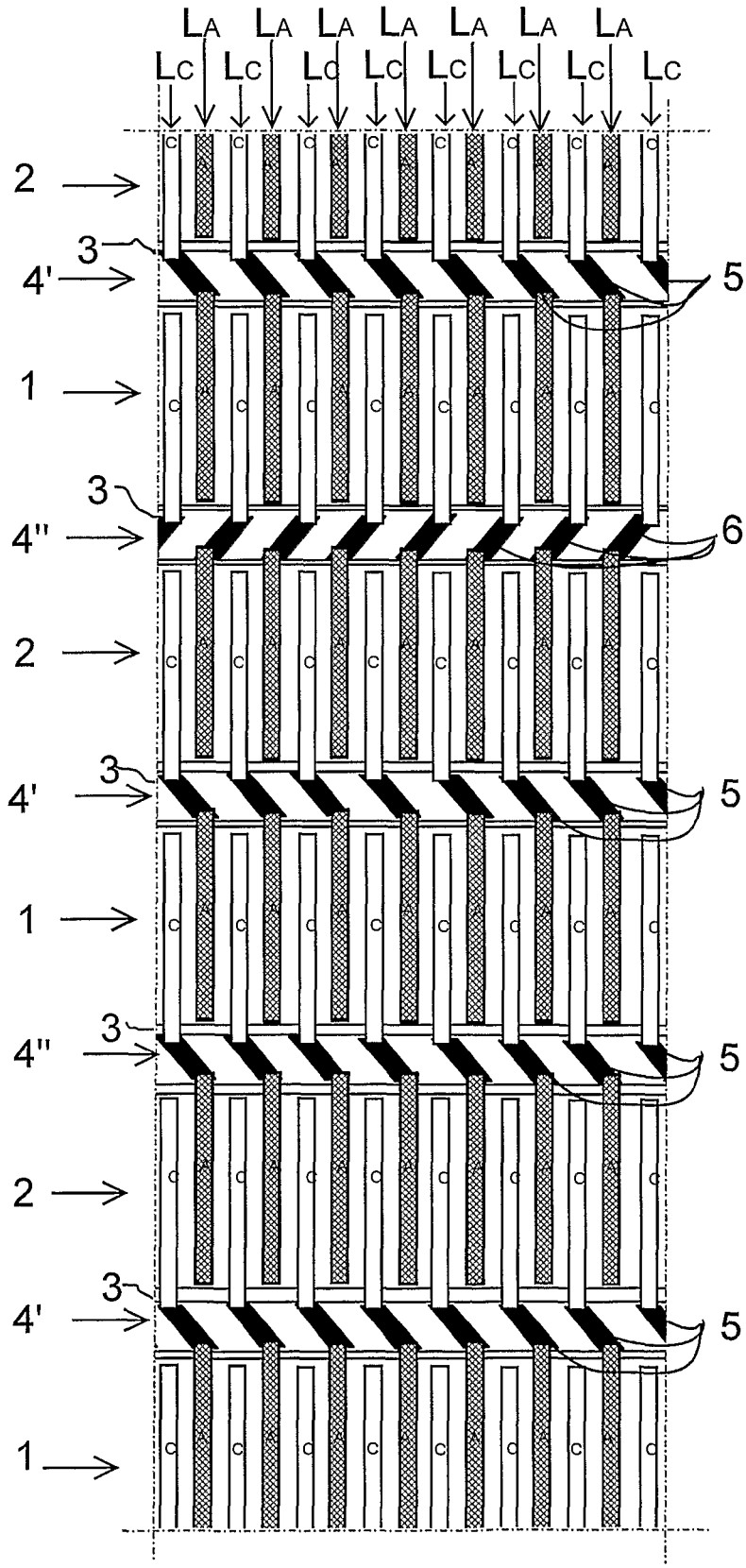
Figure 9:
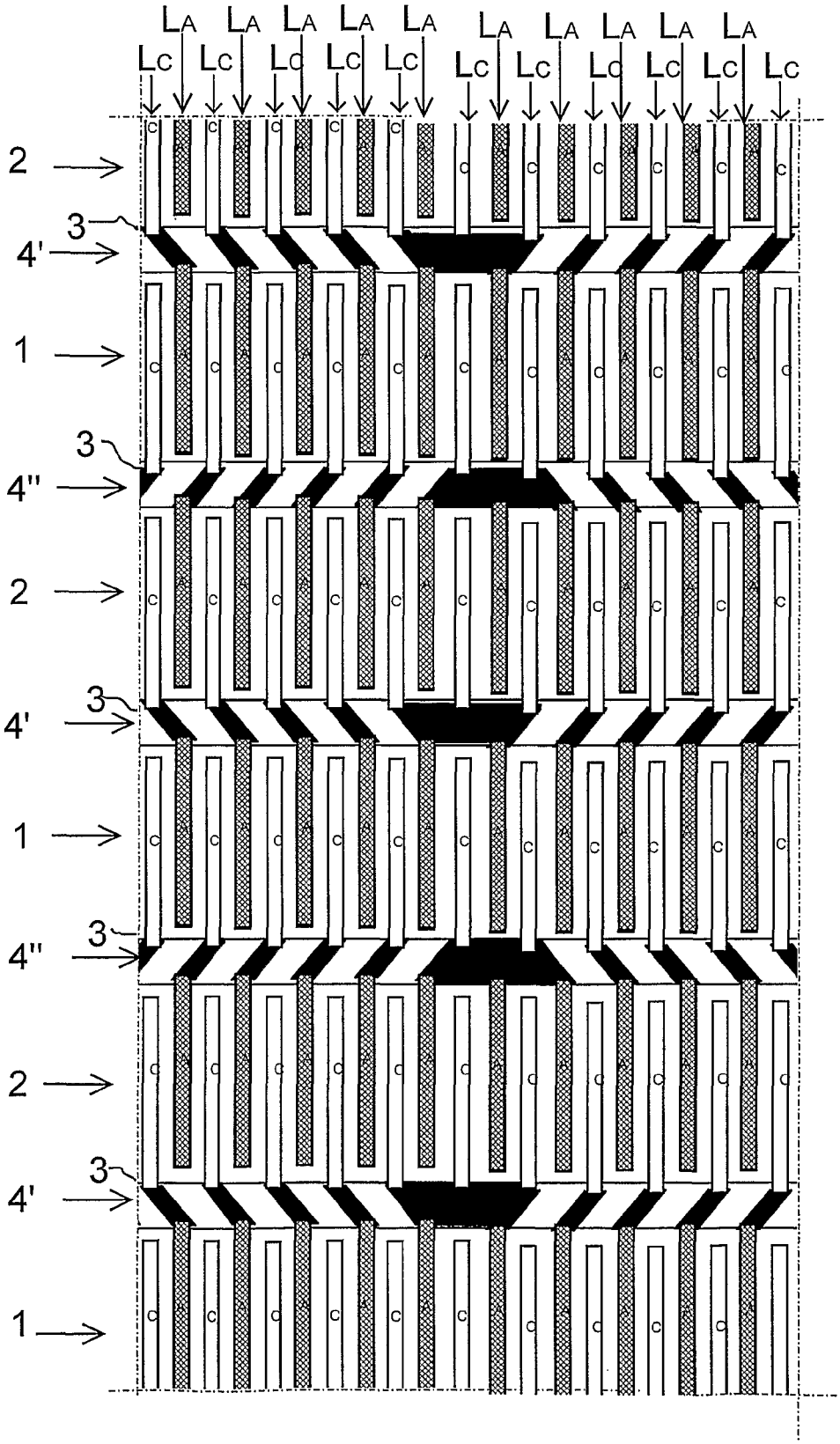
Figure 10:
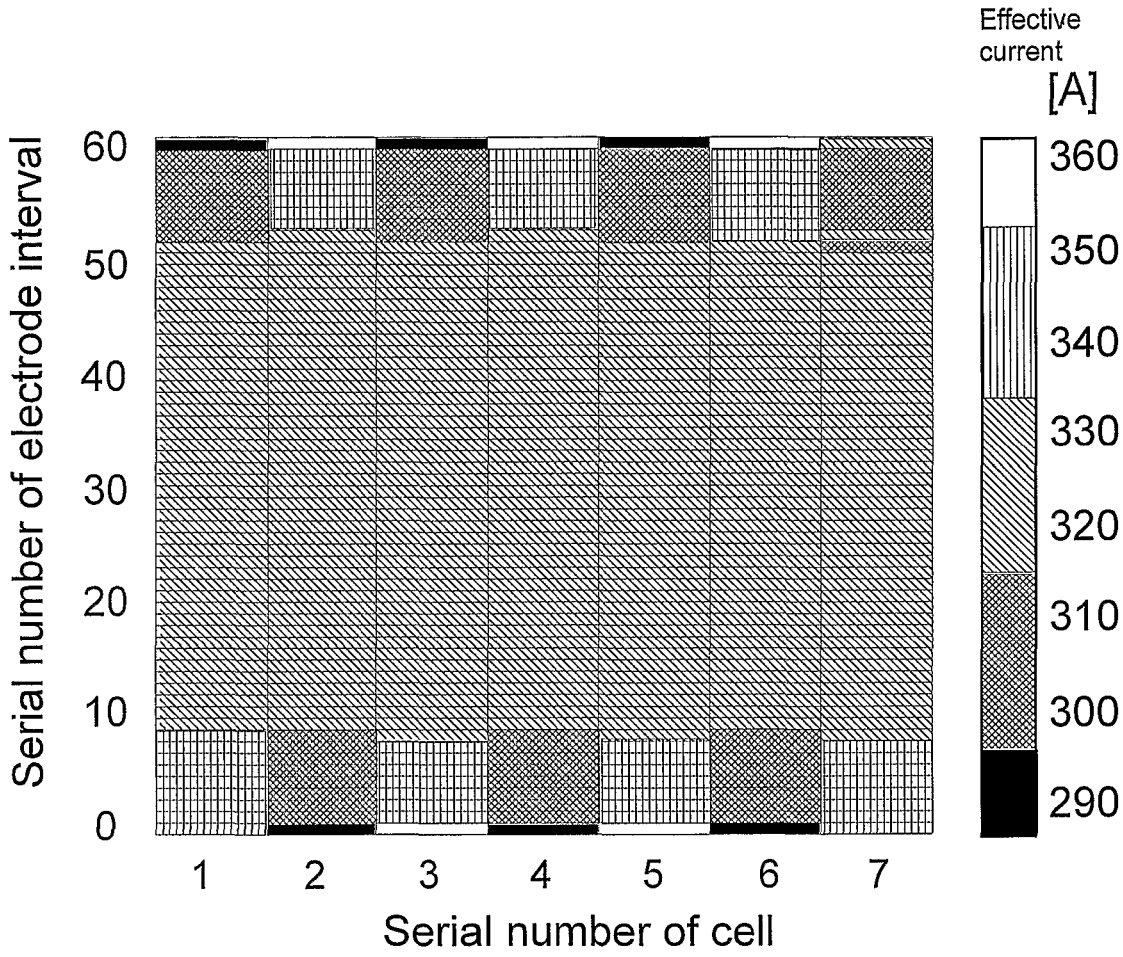
Figure 11:
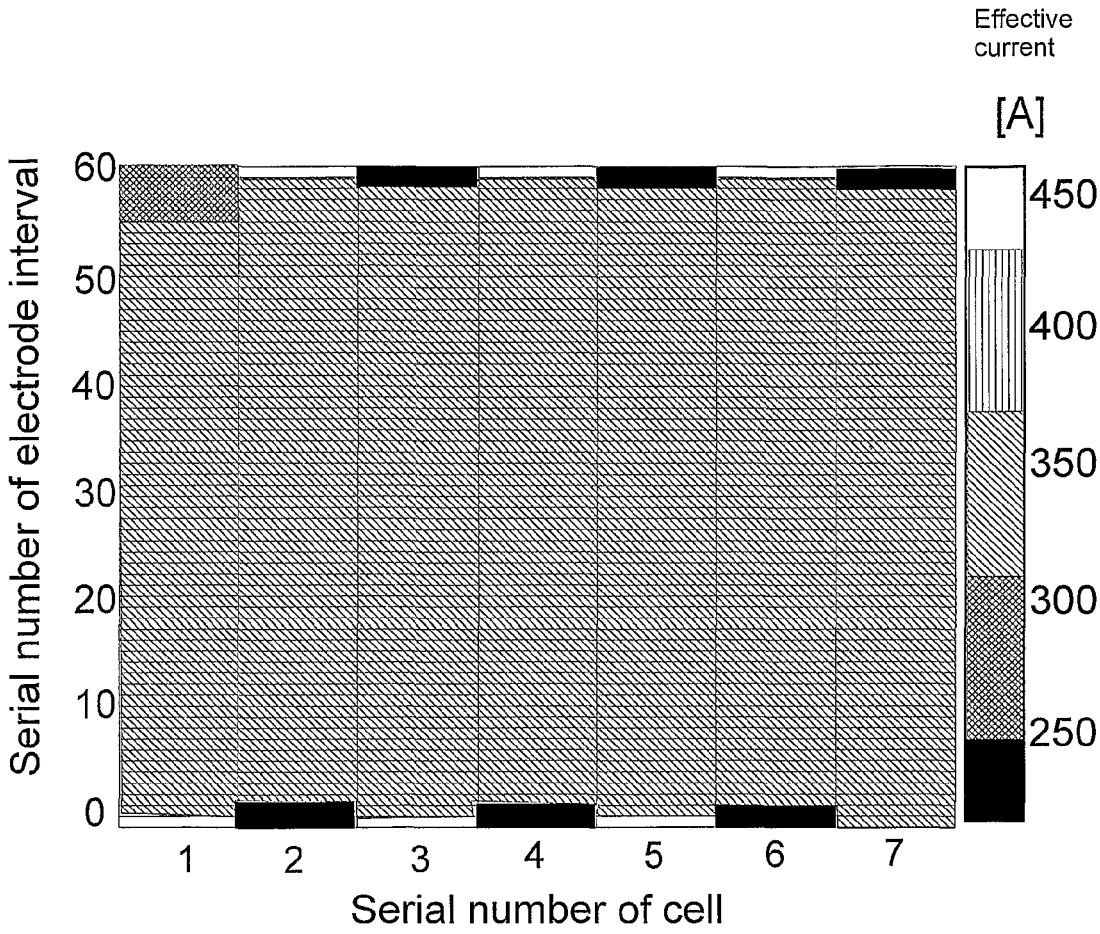
Figure 12:
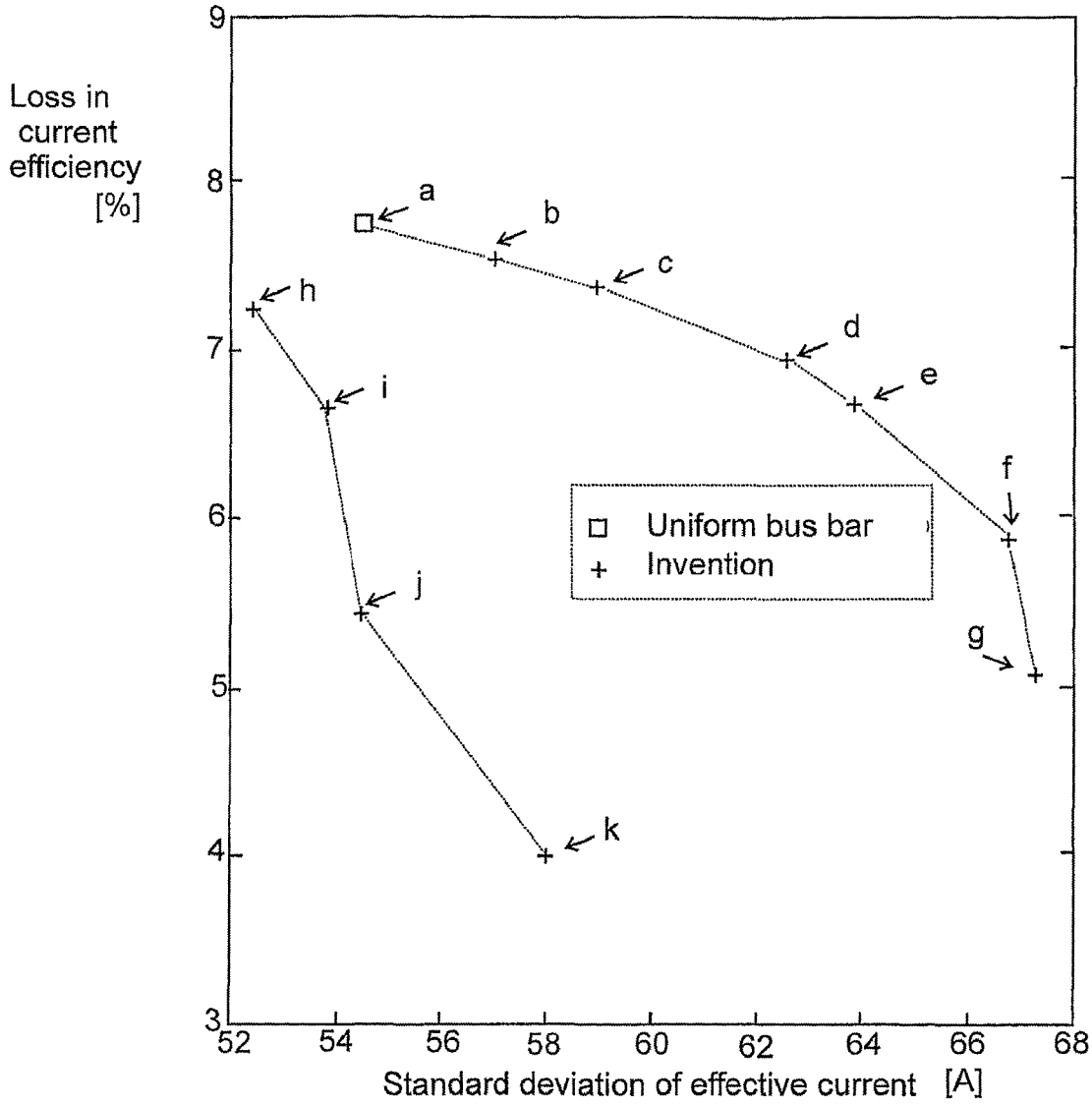

The invention is described in more detail by means of practical embodiments and with reference to the appended drawings, where FIG. 1 is a schematical top-view illustration of the prior art Optibar system, FIG. 2 illustrates the current distribution in an undisturbed situation, calculated according to FEM modeling of the prior art Optibar system, FIG. 3 illustrates, in correspondence with FIG. 1, a first embodiment of the electrolytic system according to the invention, FIG. 4 illustrates a second embodiment of the electrolytic system according to the invention, which is a modification of the system of FIG. 3, provided with equipotential bonding rails, FIG. 5 illustrates a third embodiment of the electrolytic system according to the invention, FIG. 6 illustrates a fourth embodiment of the electrolytic system according to the invention, FIG. 7 illustrates the system of FIG. 4, the end parts of the cells being provided with lengths of equipotential bonding rail, which rail lengths interconnect a few electrodes of the same cell, FIG. 8 illustrates a fifth embodiment of the electrolytic system according to the invention, FIG. 9 illustrates a sixth embodiment of the electrolytic system according to the invention, FIG. 10 illustrates, the system of FIG. 3, the ends of the cells being provided with lengths of equipotential bonding rails according to FIG. 7, where in correspondence with FIG. 2, the effective current distribution in an undisturbed situation is calculated by FEM modeling, FIG. 11 illustrates the system of FIG. 4, provided with modified end segments, where the segments interconnect several anodes and cathodes, and where the effective current distribution in an undisturbed situation is calculated by FEM modeling, and FIG. 12 illustrates the current efficiency loss in copper electrorefining with respect to the standard deviation of effective currents in different systems, calculated by simulating the FEM model, said systems having different busbars, in a power-loss situation, in which case the number of occurring short circuits is one per cell in average. In addition, the model has taken into account the location inaccuracy of the electrodes as well as contact errors.

DETAILED DESCRIPTION OF THE INVENTION

FIG. 3 shows a schematical top-view of part of the electrolytic system according to the invention. There is seen a group of adjacent electrolytic cells 1, 2, each two of said adjacent cells 1 and 2 being separated by a partition wall 3. In each cell, there is arranged, in an alternating order, a number of anodes A and cathodes C. In each cell, next to each anode A, there is always a cathode C and vice versa. Each individual anode A of each cell is in the same anode line $L_A$ with the anode of the adjacent cell. Respectively, each individual cathode C of each cell is in the same cathode line $L_C$ with the cathode of the adjacent cell. On top of each partition wall 3 between the adjacent two cells 1, 2, there is arranged a busbar 4', 4", formed of a row of conductor segments 5, 6, which segments are galvanically separated in the busbar. Each conductor segment 5, 6 galvanically connects the anode A with at least one cathode C of the adjacent cell.

In the embodiment of FIG. 3, the conductor segments 5, 6 of the busbars 4', 4" are arranged so that one anode A located in one or several anode lines $L_A$, in an alternating order in every second cell 1, is connected to one cathode C of the adjacent cell 2, said cathode being located in the adjacent cathode line $L_C$ on the first side of the anode line $L_A$, in FIG. 3 on the left-hand side. Respectively, the anode A placed in said same anode line $L_A$, in an alternating order in every second cell 2, is connected to one cathode C of the adjacent cell 1, which is located in the adjacent cathode line $L_C$ on the other side of the anode line $L_A$, i.e. on the right-hand side in the drawing. The busbars 4', 4" comprise, a first busbar 4' and a second busbar 4". The second busbar 4" is, with respect to a vertical plane that is drawn in the direction of the cell group, an inverted mirror image of the first busbar 4'. The first and second busbars are arranged in an alternating order on top of every second partition wall 3.

FIG. 4 illustrates the system according to FIG. 3, provided with equipotential bonding rails 7 and 8, which are here represented only schematically. The cross-hatched rails 7 interconnect the anodes A, and the white rails 8 interconnect the cathodes. In practice, the equipotential bonding rails 7 and 8 can be integrated in the partition wall busbar 4' and 4", for example in the same way as is described in the publication EP 1095175 B1. The anodes A placed in each cell 1, 2 are galvanically interconnected by a first equipotential bonding rail 7. Likewise, the cathodes C placed in each cell 1, 2 are galvanically interconnected by a second equipotential bonding rail 8.

FIG. 5 illustrates an embodiment of the system including a group of adjacent electrolytic cells 1, 2, where each two of said adjacent cells 1 and 2 are mutually separated by a partition wall 3. In each cell, there is arranged, in an alternating order, number of anodes A and cathodes C. In each cell, next to each anode A, there is always a cathode C, and vice versa. Each individual anode A in each cell is in the same anode line $L_A$ with the anode of the adjacent cell. Respectively, each individual cathode C in each cell is in the same cathode line $L_C$ with the cathode of the adjacent cell. On top of each partition wall 3 of the adjacent two cells 1, 2, there is arranged a busbar 4', 4", formed of a row of conductor segments 5, 6, which segments are galvanically separated in the busbar. Each conductor segment 5, 6 galvanically connects the anode A with at least one cathode C of the adjacent cell.

From FIG. 5 it is apparent that in each busbar 4', 4", the conductor segments 5, 6 are arranged so that two anodes A located in two neighboring anode lines $L_A$, in an alternating order in every second cell 1, are connected to two cathodes C of the adjacent cell 2, one cathode of which is placed in the adjacent cathode line $L_C$ located on the first side of each anode line $L_A$, i.e. on the left-hand side in the drawing. Respectively, two anodes A located in said anode lines $L_A$, in an alternating order every second cell 2, are connected to the two cathodes C of the adjacent cell 1, of which cathodes C one is located in the adjacent cathode line $L_C$ placed on the other side of each anode line $L_A$, i.e. on the right-hand side in the drawing. The busbars 4', 4" comprise a first busbar 4' and a second busbar 4". The second busbar 4" is, with respect to the vertical plane drawn in the direction of the cell group, an inverted mirror image of the first busbar 4'. The first and second busbars are arranged in an alternating order on top of every second partition wall 3.

FIG. 6 illustrates yet another embodiment of the system, with a group of adjacent electrolytic cells 1, 2, each of said two adjacent cells 1 and 2 being separated by a partition wall 3. In each cell, there is arranged, in an alternating order, a number of anodes A and cathodes C. In each cell, next to each anode A, there is always a cathode C, and vice versa. Each individual anode A in each cell is in the same anode line $L_A$ with the anode of the adjacent cell. Respectively, each individual cathode C in each cell is in the same cathode line $L_C$ with the cathode of the adjacent cell. On top of the partition wall 3 provided in between two adjacent cells 1, 2, there is arranged a busbar 4', 4", formed of a row of conductor segments 5, 6, said segments being galvanically separated in the busbar. Each conductor segment 5, 6 galvanically connects the anode A with at least one cathode C of the adjacent cell.

In FIG. 6, it can be seen that in each busbar 4', 4", the conductor segments 5, 6 are arranged so that three anodes A placed in three neighboring anode lines $L_A$, in an alternating order in every second cell 1, are connected to three cathodes C of the adjacent cell 2, of which cathodes one is located in the adjacent cathode line $L_C$ on the first side of all three anode lines $L_A$, i.e. on the left-hand side in the drawing. Respectively, three anodes A placed in said anode lines $L_A$, located in an alternating order in every second cell 2, are connected to the three cathodes C of the adjacent cell 1, of which cathodes C one is located in the adjacent cathode line $L_C$ on the other side of all three anode lines $L_A$. i.e. on the right-hand side in the drawing. The busbars 4', 4" comprise a first busbar 4' and a second busbar 4". The second busbar 4" is, in relation to a vertical plane drawn in the direction of the cell group, an inverted mirror image of the first busbar 4'. The first and second busbars are arranged in an alternating order on top of every second partition wall 3.

FIG. 7 illustrates an embodiment of the electrolytic system of FIG. 3, where at each end of each cell, five neighboring anodes A are interconnected by a length 9' of a first equipotential bonding rail, and four neighboring cathodes C are interconnected by another length 9" of the first equipotential bonding rail. Also in this embodiment the second busbar 4" is, in relation to a vertical plane drawn in the direction of the cell group, an inverted mirror image of the first busbar 4'. The first and second busbars are arranged in an alternating order on top of every second partition wall 3.

FIG. 8 illustrates an embodiment of an electrolytic system that deviates from the embodiments of FIGS. 3-7 in that here the busbar is not inverted in every second busbar located in the cell interval between two adjacent cells, but the embodiment of FIG. 8 includes several adjacent cell intervals with a similar segmented busbar 5, and after the described succession of similar busbars 5, there is arranged an inverted busbar 6, by, which the current flow is deviated in the other direction (in the drawing to the right), and in the part of the cell group illustrated in this example, there is provided one such inverted busbar. When necessary, they can also be arranged in several successive cell intervals.

FIG. 9 illustrates yet another embodiment, where the busbars 4', 4" are, in relation to themselves, inverted with reference to the vertical plane drawn in the direction of the cell group, i.e. in each busbar, the direction of the conductor segments changes on the center level of the cell interval.

FIG. 10 illustrates an effective current distribution, simulated by FEM modeling, for an electrolytic system that is modified from the Optibar system by a segmented busbar inversion according to FIG. 3. In addition, the cell ends in each cell are, according to FIG. 7, provided with lengths of equipotential bonding rail, where one length of the equipotential bonding rail interconnects five anodes, and the other length of equipotential bonding rail interconnects four cathodes. From FIG. 10 it is apparent that the effective current distribution throughout the whole cell group is fairly even. The deviation in the current distribution that was typical of the Optibar system illustrated in FIG. 2 does not occur anymore. The effective current distribution scale is roughly from 290 A to 360 A, as is indicated by the horizontal column on, the right-hand side of the distribution diagram. In the majority of the electrode intervals, the effective current remains within a good range. The maximum current, of the order roughly 360 A, occurs in the first electrode interval of every second cell and in the last electrode interval of every second cell, is remarkably lower and better than in the prior art case of FIG. 2, where the maximum current was over 700 A, and it occurred in several electrode intervals.

FIG. 11 illustrates the current distribution for a system that is obtained from the system of FIG. 3 by adding a modified current segment that at the end of the cell connects several anodes to several cathodes of the adjacent cell. From FIG. 11 it is can be seen that the current distribution still remains fairly good. Zero currents do not occur at the cell ends. The scale of the effective current distribution is now roughly from 200 A to 450 A, as is indicated in the horizontal column on the right-hand side of the distribution diagram. In the majority of the electrode intervals, the effective current remains within a good range. Likewise, the maximum current that can occur at the other end of the cells remains within a perfectly acceptable range and does not make the precipitate grow too rapidly on the cathode surface. In addition, there can be used equipotential bonding rails in order to reduce the effect of contact errors.

FIG. 12 illustrates the current efficiency as a function of the standard deviation of effective currents in cell groups provided with different partition wall contact systems.

The term 'current efficiency' here refers to the share of the current supplied in the electrolytic cell that is utilized as a metal precipitating effective current in the electrolysis. The object is to minimize the current efficiency loss. In an optimal situation, the current efficiency is 100%, i.e. the current efficiency loss is 0%, but in practice the short circuits and earth leakages occurring in the system result in that the current efficiency loss is bigger than zero. In an optimal situation, the divergence in the effective current distribution is as small as possible. Thus the target point is nearest to the bottom left-hand side corner in the coordinates of FIG. 12.

The points occurring in FIG. 12, marked by the symbols □ and +, represent sample averages of the standard deviation of the effective current and the current efficiency loss in a case with power loss. In each cell, the system includes 30 cathodes and 31 anodes, and a cell group includes seven cells.

The symbol □ illustrates a system that is provided with previously known uniform partition wall busbars (so-called Walker system), with a corresponding sample average point a), where the sample average of the current efficiency loss is nearly 8%, and the sample average of the standard deviation of the effective current is roughly 55 A.

The symbol + illustrates a system formed according to the invention, provided with inverted and segmented busbars.

The sample average points b)-g) illustrate systems provided with busbars divided into two b), three c) five d), six e), ten f) and fifteen g) parts, said busbars being in every second cell interval inverted according to the invention. It is pointed out that as the number of current segments increases, the current efficiency loss is decreased, and the standard deviation of effective currents increases. From the drawing it can be generally seen that by means of a system according to the invention b)-g), the current efficiency loss is throughout smaller than with a uniform busbar a).

The sample average point h) illustrates a system where in each cell the anodes and cathodes have equipotential bonding rails (corresponding to the system of FIG. 4). Now the standard deviation of effective currents is relatively small, roughly 53 A. The current efficiency loss is below 7.5%.

The sample average point i) illustrates a fully segmented system where in each cell, only the anodes have equipotential bonding rails. The current efficiency loss is roughly 6.5%, and the standard deviation of effective currents is roughly 54 A.

The sample average point j) illustrates a fully segmented system where in each cell, only cathodes have equipotential bonding rails. Now the current efficiency loss is roughly 5.5%, and the standard deviation of effective currents is roughly 54 A.

The sample average point k) illustrates a fully segmented system where, according to FIG. 7, the equipotential bonding rails at both ends of the cell connect 5 anodes and 4 cathodes. Now the current efficiency loss is roughly 4%, and the standard deviation of effective currents is roughly 58 A. By means of this structure, there is achieved an even current distribution in an undisturbed situation, and a good performance in a power-loss situation.

All embodiments b)-k) according to the invention are so-called Pareto optimal. Points h)-k) prove that it is profitable to fully segment (and invert) the partition wall busbar (as in FIG. 3), and when necessary, equipotential bonding rails can be used, and the situation is never worse than in the case of point a).

By means of the prior art Optibar system, the standard deviation of effective currents would be of the order roughly 100 A, and would therefore not fit in the graph of FIG. 12, because the standard deviation of effective currents would be so large.

The invention is not restricted to the above described embodiments only, but many modifications are possible without departing from the scope of the inventive idea defined in the appended claims.

The invention claimed is:

1. A method for arranging electrodes in an electrolytic process, in which method a number of electrolytic cells are arranged as a cell group, where the cells are mutually separated by a number of partition walls, in each cell, there is arranged, in an alternating order, a number of anodes and cathodes, so that in each cell, there is arranged a cathode next to each anode, and so that in each cell, each individual anode is fitted in the same anode line with the anode of the adjacent cell, and each individual cathode in each cell is fitted in the same cathode line with the cathode of the adjacent cell, and that each anode is galvanically connected to at least one cathode of the adjacent cell, wherein the flowing direction of the current in the cell group is deviated in different directions in order to make it flow mainly in the direction of the cell group.

2. A method according to claim 1, wherein one or several anodes, placed in one or several anode lines of one or several cells in a cell group, are connected to one or several cathodes of the adjacent cell, of which at least one cathode is placed in the adjacent cathode line on the first side of said one or several anode lines, and that one or several anodes, placed in some other one or several anode lines in one or several cells of the cell group, are connected to one or several cathodes of the adjacent cell, of which at least one cathode is located in the adjacent cathode line, placed on the second side of said one or several anode lines.

3. A method according to claim 1, wherein one or several anodes, located in one or several anode lines, in an alternating order in every second cell, are connected to one or several cathodes of the adjacent cell, of which cathodes at least one cathode is placed in the adjacent cathode line located on the first side of said one or several anode lines, and respectively, one or several anodes located in said one or several anode lines, in an alternating order in every second cell, are connected to one or several cathodes of said adjacent cell, of which cathodes at least one cathode is placed in the adjacent cathode line located on the second side of said one or several anode lines.

4. A method according to claim 1, wherein each individual anode in each cell is galvanically connected to an individual cathode of the adjacent cell.

5. A method according to claim 1, wherein in each cell, two or several anodes are galvanically connected to each other and to a corresponding number of cathodes of the adjacent cell.

6. A method according to claim 1, wherein at the end of the cell, one or several anodes are connected to one or several cathodes of the adjacent cell.

7. A method according to claim 1, wherein in each cell, the anodes are galvanically connected to each other in order to balance the potential.

8. A method according to claim 1, wherein in each cell, the cathodes are galvanically connected to each other in order to balance the potential.

9. An electrolytic system including a number of electrolytic cells, separated by a number of partition walls; in each cell, there is arranged, in an alternating order, a number of anodes and cathodes, so that in each cell, next to each anode there is arranged a cathode, and so that in each cell, each individual anode is in the same anode line with the anode of the adjacent cell, and in each cell, each individual cathode is in the same cathode line with the cathode of the adjacent cell, a busbar that is arranged on top of each partition wall arranged between two adjacent cells, which busbar is formed of a row of conductor segments that are galvanically separated, each of said conductor segments being arranged to galvanically connect each anode with at least one cathode of the adjacent cell, in which busbars the conductor segments are arranged so that the anode located in one or several anode lines in one or several cells of a cell group, is connected to the cathode of the adjacent cell, which cathode is located in the adjacent cathode line placed on the first side of said anode line, and the anode placed in said one or several anode lines in one or several other cells of the cell group, is connected to the cathode of the adjacent cell, wherein one or several anodes, located in said one or several anode lines in said one or several other cells of a cell group, are connected to one or several cathodes of the adjacent cell, and of which cathodes at least one cathode is placed in the adjacent cathode line located on the second side of said one or several anode lines.

10. A system according to claim 9, wherein one or several anodes, placed in an alternating order in every second cell in one or several anode lines, are connected to one or several cathodes of the adjacent cell, of which cathodes at least one is placed in the adjacent cathode line located on the first side of said one or several anode lines, and respectively one or several anodes placed in one or several anode lines, in an alternating order every second cell, are connected to one or several cathodes of the adjacent cell, of which cathodes at least one located in the adjacent cathode line placed on the second side of said one or several anode lines.

11. A system according to claim 9, wherein in each cell, each individual anode is galvanically connected to an individual cathode of the adjacent cell.

12. A system according to claim 9, wherein in each cell, two or several anodes are galvanically connected to each other and to a corresponding number of cathodes of the adjacent cell.

13. A system according to claim 9, wherein the system includes a conductor, which is located at the end of the cell and by which one or several anodes are connected to one or several cathodes of the adjacent cell.

14. A system according to claim 9, wherein the busbars comprise a first busbar and a second busbar, which is, in relation to a vertical plane positioned in the direction of the cell group, an inverted mirror image of the first busbar.

15. A system according to claim 14, wherein the first and second busbars are arranged in an alternating order on top of every second partition wall.

16. A system according to claim 9, wherein the anodes placed in each cell are galvanically connected to each other by means of a first equipotential bonding rail.

17. A system according to claim 9, wherein the cathodes placed in each cell are galvanically connected to each other by means of a second equipotential bonding rail.

* * * * *